US008905324B2

(12) United States Patent
Ballu et al.

(10) Patent No.: US 8,905,324 B2
(45) Date of Patent: Dec. 9, 2014

(54) PROJECTOR AND MEMBER FOR SPRAYING A COATING MATERIAL, AND SPRAYING METHOD USING SUCH A SPRAYER

(75) Inventors: Patrick Ballu, Reims (FR); Didier Chevron, Moirans (FR)

(73) Assignee: Sames Technologies, Meylan (FR)

( * ) Notice: Subject to any disclaimer, the term of this patent is extended or adjusted under 35 U.S.C. 154(b) by 491 days.

(21) Appl. No.: 13/320,249

(22) PCT Filed: May 12, 2010

(86) PCT No.: PCT/FR2010/050925

§ 371 (c)(1),
(2), (4) Date: Jan. 27, 2012

(87) PCT Pub. No.: WO2010/130955

PCT Pub. Date: Nov. 18, 2010

(65) Prior Publication Data

US 2012/0118996 A1 May 17, 2012

(30) Foreign Application Priority Data

May 13, 2009 (FR) ..... 09 53139

(51) Int. Cl.
*B05B 3/10* (2006.01)
*B05B 7/00* (2006.01)
*B05C 5/00* (2006.01)

(52) U.S. Cl.
CPC ..... *B05B 3/1014* (2013.01); *B05B 3/1064* (2013.01); *B05B 3/1092* (2013.01)
USPC ..... 239/223; 239/7; 118/300

(58) Field of Classification Search
CPC .. B05B 3/1014; B05B 3/1064; B05B 3/1092; B05B 5/0407; B05B 5/0426; B05B 13/0452
USPC ..... 239/7, 8, 214, 214.11, 214.15, 214.17, 239/223, 224, 263, 290, 293, 296, 299, 311, 239/700, 701, 703, 705; 118/300
See application file for complete search history.

(56) References Cited

U.S. PATENT DOCUMENTS

| | | | | |
|---|---|---|---|---|
| 6,050,499 | A * | 4/2000 | Takayama et al. | 239/112 |
| 6,189,804 | B1 * | 2/2001 | Vetter et al. | 239/7 |
| 6,659,367 | B2 * | 12/2003 | Ballu | 239/223 |
| 2004/0000604 | A1 * | 1/2004 | Vetter et al. | 239/700 |
| 2008/0277496 | A1 * | 11/2008 | Yasuda et al. | 239/112 |
| 2009/0008469 | A1 * | 1/2009 | Seitz et al. | 239/3 |

FOREIGN PATENT DOCUMENTS

| | | | |
|---|---|---|---|
| DE | 102007012878 | B3 | 10/2008 |
| EP | 1514605 | A2 | 3/2005 |

OTHER PUBLICATIONS

International search report for application No. PCT/FR2010/050925 dated Sep. 27, 2010.

* cited by examiner

*Primary Examiner* — Darren W Gorman
(74) *Attorney, Agent, or Firm* — Patterson & Sheridan, L.L.P.

(57) ABSTRACT

The invention relates to a rotary sprayer for spraying a coating material, comprising a fixed body, a spraying member, a device for rotating the spraying member about a rotational axis, and a flow path for supplying the spraying member with a coating material. The spraying member for the coating material includes a flow surface for receiving the coating material and an edge for spraying the coating material. The rotary sprayer further includes a device for injecting air into a region located radially inside the space defined by the flow surface and upstream from the edge, the air-injecting device being separate from the coating material supply flow path. The air-injecting device includes an air dispenser arranged in an upstream portion of the flow surface, which injects air into a central area of the surface.

17 Claims, 5 Drawing Sheets

PROJECTOR AND MEMBER FOR SPRAYING A COATING MATERIAL, AND SPRAYING METHOD USING SUCH A SPRAYER

BACKGROUND OF THE INVENTION

The present invention relates to a rotary projector for a coating material. The present invention also relates to a rotary spraying member for a coating material. Furthermore, the present invention relates to a method for spraying a coating material using such a rotary projector.

Traditional spraying using rotary projectors is used to apply a coating material on objects to be coated, such as motor vehicle bodies. Coating material refers to any material intended to be projected in the form of droplets on an object to be coated, such as a finish, paint or varnish, or a phytosanitary material to be sprayed on plants, etc.

A rotary projector for projecting a coating material includes a spraying member rotating at high speeds under the effect of rotational driving means, such as a compressed air turbine. Such a spraying member generally assumes the form of a bowl with rotational symmetry and it includes at least one spraying edge able to form a jet of coating material. The rotary projector also includes a fixed body housing the rotating means as well as means for supplying the spraying member with coating material.

The jet of coating material sprayed by the edge of the rotary member assumes a generally conical shape that depends on parameters such as the speed of rotation of the bowl and the flow rate of the coating material. To control the shape of the jet, the rotary projectors of the prior art are generally equipped with several orifices. These orifices are formed in the body of the rotary projector, on a circle situated on the outer perimeter of the bowl and centered on the axis of symmetry of the bowl. These orifices are intended to emit jets of air making it possible to shape the jet of coating material.

JP-A-8 071 455 describes such a rotary projector for which the air jets emitted from the outer perimeter of the bowl are intended to reduce the vacuum existing downstream of the bowl and to obtain a uniform deposited film of paint.

However, such a rotary projector induces relatively high air speeds, which risks deteriorating, qualitatively and quantitatively, the application of the coating material on the object to be coated.

Qualitatively on the one hand, an object coated using such a rotary projector has impacts whereof the profiles are sometimes irregular and generally not very robust. The robustness of an impact from a rotary projector of a coating material corresponds substantially to the regularity of a curve showing, as a function of a particular parameter such as the skirt air flow rate, the "impact width," i.e. the width of the middle or upper deposited thickness area, considered in a direction perpendicular to the direction of the relative movement between the rotary projector and the object to be coated.

Quantitatively on the other hand, the deposition yield of such a rotary projector is relatively limited. The deposition yield, also called transfer efficiency, is the ratio of the quantity of coating material deposited on the object to be coated to the quantity of coating material projected using the rotary projector.

DE-A-10 2007 012 878 discloses a projector in which a flow of air is used to shape a central jet of paint and press a peripheral flow against a flow surface of a bowl. The air injection means situated outside the flow surface of the bowl does not make it possible to act on the robustness of the coating material impact or the deposition yield.

The present invention aims in particular to resolve these drawbacks by proposing a rotary projector for a coating material making it possible to overcome the vacuum downstream of the bowl, obtain a good robustness of the coating material impact on the objects to be coated, and limit dirtying of the components of the bowl.

SUMMARY OF THE INVENTON

To that end, the invention relates to a rotary projector for a coating material, comprising a fixed body, a coating material spraying member, means for rotating the spraying member around a rotational axis, and means for supplying the spraying member with a coating material, while the spraying member for the coating material includes at least one flow surface for receiving the coating material and at least one edge for spraying the coating material, the edge being in fluid communication with the flow surface. This rotary projector also comprises means for injecting air into a region located radially inside the space defined by the flow surface and upstream from the edge, said air-injecting means being separate from the coating material supply means. Furthermore, the air-injecting means includes an air dispenser arranged in an upstream portion of the flow surface, which injects air into a central area of said flow surface.

Owing to the invention, in particular the arrangement of the air dispenser, air can be injected into the spraying member, during the supply of paint, which improves the robustness and deposition yield during spraying. Within the meaning of the invention, the fact that the air dispenser is arranged in the upstream part of the flow surface means that it is radially surrounded by said surface and situated axially at least at one part of said surface.

According to other advantageous but optional features of the invention, considered alone or according to all technically allowable combinations:

- the air-injecting means are arranged so as to orient all or some of the air toward the flow surface;
- the air dispenser is separate from the spraying member and stationary relative to the fixed body;
- the air dispenser comprises a nozzle that is removably fastened to the means for injecting air and/or the supply means;
- the means for injecting air comprise an air pipe extending upstream of the spraying member, the downstream section of the air pipe extending substantially parallel and close to the axis of rotation, said downstream section preferably being coaxial to the axis of rotation;
- the means for supplying the coating material comprise a tubing whereof the downstream section extends generally parallel to the air pipe and spaced away from the axis of rotation;
- the means for supplying the coating material comprise a tubing that is tubular and extends around the air pipe;
- the air dispenser is made at a downstream portion of the air pipe;
- the air dispenser is secured to the spraying member;
- the air dispenser has at least one opening arranged upstream of the air dispenser to receive a stream of air, as well as at least one channel extending downstream of the opening;
- the air dispenser has several channels that converge downstream of the opening and the discharge directions of which are distributed in a solid angle greater than the solid angle inscribing the flow surface and smaller than $2\pi$ steradians (sr), certain channels being oriented toward the flow surface;

the downstream axial surface of the air dispenser is completely or partially planar;

the downstream axial surface of the air dispenser is curved, preferably in the shape of a sphere portion; and the flow surface generally has a symmetry of revolution relative to the axis of rotation and the air dispenser has a globally tapered outer surface around the axis of rotation, the outer surface defining, with the flow surface, a passage for the coating material.

Furthermore, the present invention relates to a rotary member for spraying a coating material comprising at least one flow surface intended to receive the coating material conveyed by the means for supplying the coating material and at least one edge for spraying said coating material, the edge being in fluid communication with the flow surface. This rotary member also comprises means for injecting air into a region situated radially inside the volume delimited by the flow surface and upstream of the edge, the air-injecting means being separate from the means for supplying coating material. The air-injecting means comprise an air dispenser that is arranged in an upstream part of the flow surface to inject air into a central region, radially and axially, of the flow surface and that is integral with the spraying member.

The invention also relates to a method for projecting a coating material, using a rotary projector as described above, and comprising the following steps:

supplying the spraying member with coating material;

injecting air into a region situated radially inside the volume delimited by the flow surface using the air dispenser arranged in an upstream part of the flow surface of the spraying member;

selecting one or more air flow(s), in a continuous, variable or direct mode, flowing into the air-injecting means.

BRIEF DESCRIPTION OF THE DRAWINGS

The invention will be well understood and its advantages will also emerge in light of the following description, provided solely as a non-limiting example and done in reference to the appended drawings, in which.

DETIALED DESCRIPTION OF THE INVENTION

Figure 1:
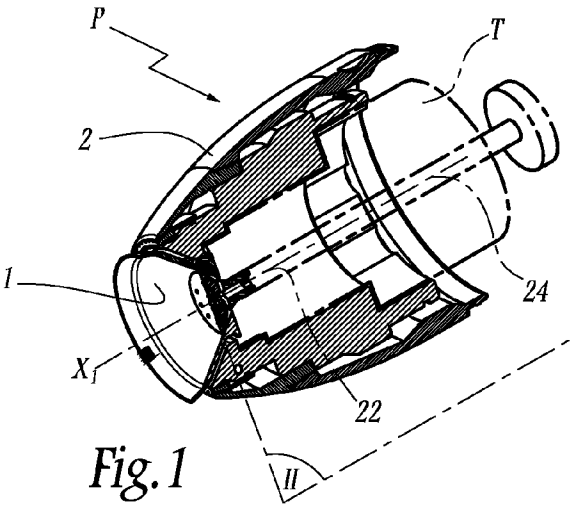
FIG. 1 is a perspective view with a tear-away of a rotary projector according to the invention, comprising a spraying member according to the invention.

FIG. 1 shows a rotary projector P for projecting a coating material having a spraying member 1, hereafter called a bowl. The bowl 1 is housed partially inside a fixed body 2. The bowl 1 is shown in a spraying position where it is rotated at a high speed around an axis $X_1$ by rotating means, such as an air turbine T, the enclosure of which is shown in broken lines in FIG. 1. The axis $X_1$ therefore constitutes the axis of rotation of the bowl 1. The speed of rotation of the bowl 1 when loaded, i.e. when it is spraying the coating material, can be between 25,000 rpm and 100,000 rpm.

The fixed body 2 is called "fixed" because it does not rotate around the axis $X_1$. The fixed body 2 can be mounted on a holder (not shown) such as a multi-axis robot arm.

Figure 2:
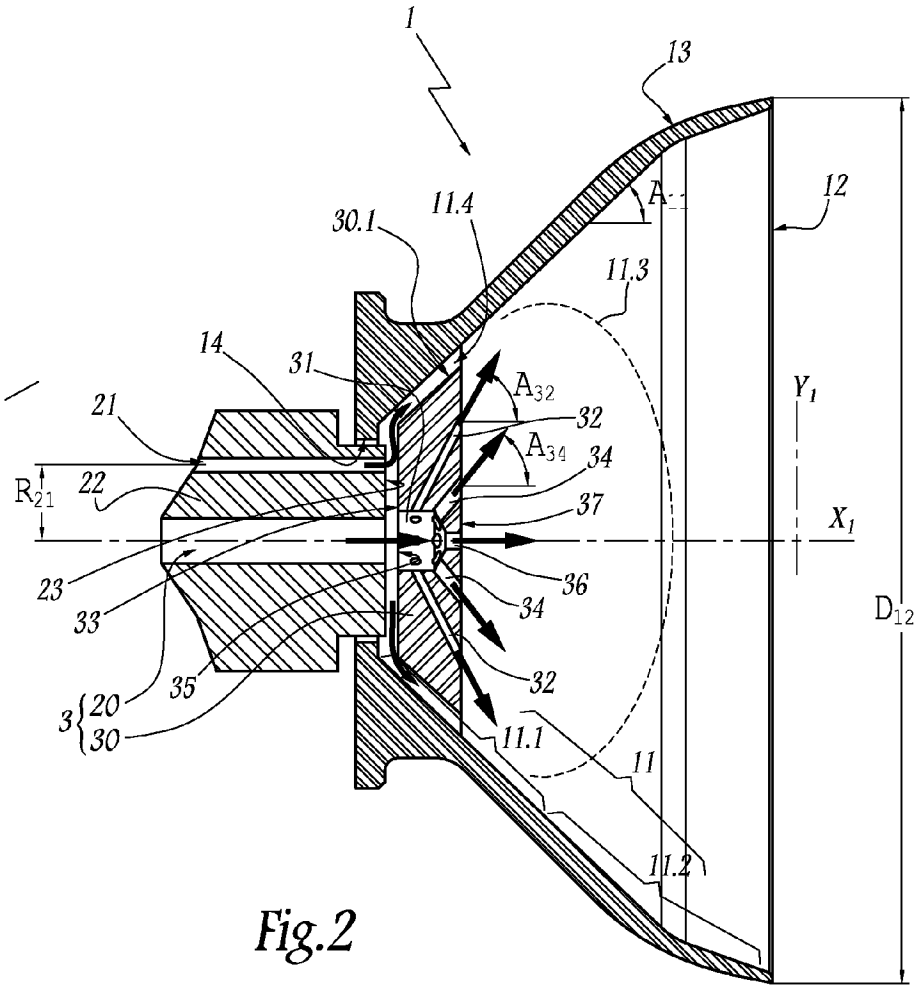
FIG. 2 is a cross-sectional view, on a larger scale and along plane II in FIG. 1, of part of the projector.

As shown in FIG. 2, the bowl 1 has a symmetry of revolution around the axis $X_1$. The bowl 1 comprises a flow surface 11, which is intended to receive the coating material in a film that spreads, under the effect of the centrifugal force, up to an edge 12 where said material is micronized in fine droplets. Flow surface refers to the hollow inner surface of the bowl 1, i.e. its surface facing the axis $X_1$. The edge 12 and the flow surface 11 are in fluid communication, so that the film of coating material can flow from the flow surface 11 to the edge 12 that borders the flow surface on the downstream side.

All of the droplets sprayed at the edge 12 form a jet of coating material, not shown, which leaves the bowl 1 and is oriented toward an object to be coated (not shown), on which said jet produces an impact. The bowl 1 has an outer surface 13 that faces the fixed body 2. The outer surface 13 is called "outer" because it does not face the axis $X_1$. On the contrary, the flow surface 11 can be called "inner" because it faces the axis $X_1$.

As shown in FIG. 2, the flow surface 11 is made up of an upstream part 11.1, which is tapered with axis $X_1$, and a downstream part 11.2, which is made up of two tapered surfaces with axis $X_1$ juxtaposed and connected to each other, the angle at the apex of the tapered surface connected to the edge 12 being smaller than the angle at the apex of the tapered surface connected to the upstream part 11.1.

The edge 12 is globally in the shape of a circle with diameter $D_{12}$ centered on the axis $X_1$. Notches (not shown) are made between the flow surface 11 and the edge 12 to improve the control of the size of the sprayed droplets at the edge 12. The diameter $D_{12}$ can for example be equal to 65 mm.

As shown in FIG. 1, the rotary projector P also includes a conduit 24 to convey the fluids, liquid or gaseous, that participate in the operation of the inventive bowl 1. The conduit 24 is illustrated in broken lines in FIG. 1 and its downstream section 22 is partially illustrated in FIG. 2.

During a spraying phase, the conduit 24 makes it possible to bring air and coating material to the bowl 1. During a cleaning phase of the rotary projector P and the bowl 1, the conduit 24 makes it possible to bring cleaning solvents and air to the bowl 1.

As shown in FIG. 2, the downstream section 22 of the conduit 24 comprises an air pipe 20 and a tubing 21 for supplying the bowl 1 with coating material. The downstream section of the air pipe 20 has a cylindrical shape that extends upstream of the bowl 1 and coaxially to the axis $X_1$. Alternatively, the downstream section of the air pipe 20 can extend globally parallel and close to the axis $X_1$.

The terms "upstream" and "downstream" refer to the flow direction of the coating material from the base of the rotary projector P, situated on the right of FIG. 1, to the edge 12, situated on the left of FIG. 1.

The tubing 21 forms a means for supplying the bowl 1 with coating material. The downstream section of the tubing 21 is formed by a cylindrical piercing that extends substantially parallel to the air pipe 20, therefore to the axis $X_1$, at a radial distance $R_{21}$ from the axis $X_1$. In other words, the tubing 21 is eccentric in the conduit 22 relative to the air pipe 20. As a complement to the tubing 21, in particular upstream thereof, the rotary projector P can include other supply means for bringing the coating material into the tubing 21.

The term "axial" refers to an entity, piece or direction that extends along the axis $X_1$ of rotation and symmetry of the bowl 1. The term "radial" applies to an entity, piece or direction that extends in a direction perpendicular to the axis $X_1$, such as direction $Y_1$ in the plane of FIG. 2.

Alternatively, the tubing 21 can have, like the tubing 121 described below relative to FIG. 3, a tubular shape extending around the air pipe and coaxially to the axis of rotation. Such a tubular shape makes it possible to distribute the coating material uniformly on the perimeter of the air dispenser and in the space separating the upstream surface of the air dispenser and the downstream surface of the conduit.

As shown in FIG. 2, the rotary projector P also comprises an air dispenser 30 that is arranged near the end surface 23 of the downstream section 22 of the conduit 24. The end portion of the downstream section 22 extends through a circular upstream opening 14 formed in the bowl 1. The air dispenser 30 is arranged in the upstream part 11.1 of the flow surface 11. The air dispenser 30 is arranged downstream, relative to the air flow direction, of the air pipe 20.

In the first embodiment illustrated in FIG. 2, the air dispenser 30 is integral with the bowl 1. The air dispenser 30 and the bowl 1 are secured using fastening means that extend around the axis $X_1$, but not in the plane of FIG. 2, where they are therefore not shown. These fastening means can for example be made up of magnets or screws.

The air pipe 20 and the air dispenser 30 form means 3 for injecting air into a region situated radially inside the volume delimited by the flow surface 11 and upstream of the edge 12. This region is delimited on the one hand by the air dispenser 30 and on the other hand by the downstream part 11.2 of the flow surface 11.

In this application, the expression "inject air" refers to the injection of air into the volume delimited by the flow surface of the bowl, with the result that said air then flows beyond the bowl 1. Aside from this air that can be described as "central," the rotary projector can be equipped with straight and/or oblique (vortex) skirt air injection means, as known in itself.

The air-injecting means 3, i.e. the air tubing 20 associated with the air dispenser 30, are separate from the means for supplying the bowl 1 with coating material, which in particular comprise the tubing 21. Thus, it is possible, during spraying of coating material, to inject air concomitantly with the supply of coating material to the bowl 1.

In the first embodiment of the invention, which is illustrated in FIG. 2, the air dispenser 30 is arranged to inject air into a central region 11.3 that belongs to the volume delimited by the flow surface 11. The term "central" applies to the position of the central region 11.3 both in the radial direction $Y_1$ and in the axial direction $X_1$. The air dispenser 30 has an opening 35 that is arranged on the upstream side of the air dispenser 30 so as to receive an air flow coming from the air pipe 20. To that end, the opening 35 is placed opposite and near the downstream end of the air pipe 20. The diameter of the opening 35 corresponds substantially to the diameter of the air pipe 20.

The air dispenser 30 includes several channels 32, 34 and 36 that extend rectilinearly in the air dispenser 30. The channels 32, 34 and 36 converge in a shared chamber 31 situated downstream of the opening 35. Aside from the channels 32, 34 and 36 shown in the plane of FIG. 2, the air dispenser 30 comprises channels that extend outside the plane of FIG. 2 and the intake orifices of which are visible at the shared chamber 31. In other words, the air dispenser 30 assumes the form of a knob. In practice, the number of channels is between 1 and 30.

The air dispenser 30 includes a pair of channels 32 and a pair of channels 34 that are respectively symmetrical relative to the axis $X_1$. The air jets produced by the channels 32, 34 and 36, when they are supplied by the air pipe 20, are shown by straight arrows, even if in reality these are substantially conical or cylindrical air jets.

The expanse of the central region 11.3 can vary depending on the geometry and usage parameters, such as the air flow rate or the orientation of the channels 32, 34 and 36.

The direction of each channel 32 forms an angle $A_{32}$ with the axis $X_1$. The direction of each channel 34 forms an angle $A_{34}$ with the axis $X_1$. The direction of each channel 36 forms a zero angle with the axis $X_1$. In practice, the angles $A_{32}$, $A_{34}$, and $A_{36}$ are between 0° and 80°. The respective directions of the channels 32, 34 and 36 are therefore distributed in a solid angle smaller than $2\pi$ sr.

In other words, the channels 32 and the channels 34 are oriented toward the flow surface, the upstream portion 11.1 of which forms an angle $A_{11}$ with the axis $X_1$. The respective directions of the channels 32, 34 and 36 are therefore distributed in a solid angle that is greater than the solid angle inscribing the flow surface 11. Thus, the air-injecting means, the air tubing 20 and the air dispenser 30 are arranged so as to orient part of the air toward the flow surface 11. This part of the injected air in particular makes it possible to thin the film of coating material spread on the flow surface 11 by "laminating" it.

In the first embodiment, illustrated in FIG. 2, the downstream axial surface 37 of the air dispenser 30 assumes the form of a completely flat disk where the output orifices of the channels 32, 34 and 36 emerge. The planar or flat shape of the downstream axial surface 37 defines an air dispenser 30 that is easy to manufacture and makes it possible to obtain continuous or less disrupted air flows and reduced dirty areas.

The positions of these output orifices, as well as the respective lengths and diameters of the channels 32, 34 and 36, are determined to inject air into the central region 11.3. Combined with the rotation of the air dispenser 30 with the bowl 1, this makes it possible to push the bowl 1 further, to mitigate or even overcome the vacuum existing downstream of the bowl 1.

The air dispenser 30 has an outer surface 30.1 that is globally tapered with axis $X_1$. The angle at the apex of the outer surface 30.1 is equivalent to the angle at the apex of the upstream part 11.1 of the flow surface 11. In other words, the outer surface 30.1 extends parallel to the upstream part 11.1. Thus, the outer surface 30.1 and the upstream part 11.1 define a passage 11.4 between them for the coating material. The passage 11.4 makes it possible to orient the coating material coming from the tubing 21 toward the flow surface 11, where it spreads to form a film.

During operation, during the spraying of the coating material, the bowl 1 and its air dispenser 30 are rotated by the air turbine T. The coating material flows in the tubing 21, inside the conduit 22, until it fills the space separating the end surface 23 from the upstream surface 33 of the air dispenser 30. Then, the coating material flows through the space 11.4 and spreads on the flow surface 11 up to the edge 12, where it is sprayed in fine droplets.

Before or concomitantly with this supply of coating material, the air-injecting means 3, which comprise the air pipe 20 and the air dispenser 30, are supplied with compressed air that they convey and distribute in the central region 11.3. The supply of air is maintained as long as the bowl is supplied with coating material. The air thus injected then flows downstream of the bowl 1, then mixes with the stream of sprayed coating material. The air thus injected therefore makes it possible to offset the vacuum existing downstream of the bowl 1.

More specifically, a short initial phase may consist of producing the compressed air in the air pipe 20 and in the air dispenser 30 before producing the paint in the tubing 21. This initial phase makes it possible to avoid the paint rising back up on and in the air dispenser 30.

Furthermore, the air discharged by the channels 32 and 34 is oriented toward the flow surface 11, which contributes to the spreading or laminating of the film of coating material on the flow surface 11.

Moreover, the air thus injected into the central region 11.3 limits the returns of the coating material inside the flow surface 11 and on the downstream surface 37 of the air dispenser 30, which reduces dirtying of the bowl 1, and therefore the amount of solvent necessary to clean it.

Furthermore, this air injection improves the performance of the coating material application on the object to be coated, as detailed below relative to FIG. 8. It has also been noted that the air injection at the center of the bowl 1 does not decrease the deposition yield, also called the transfer efficiency, of the application.

Figure 8:
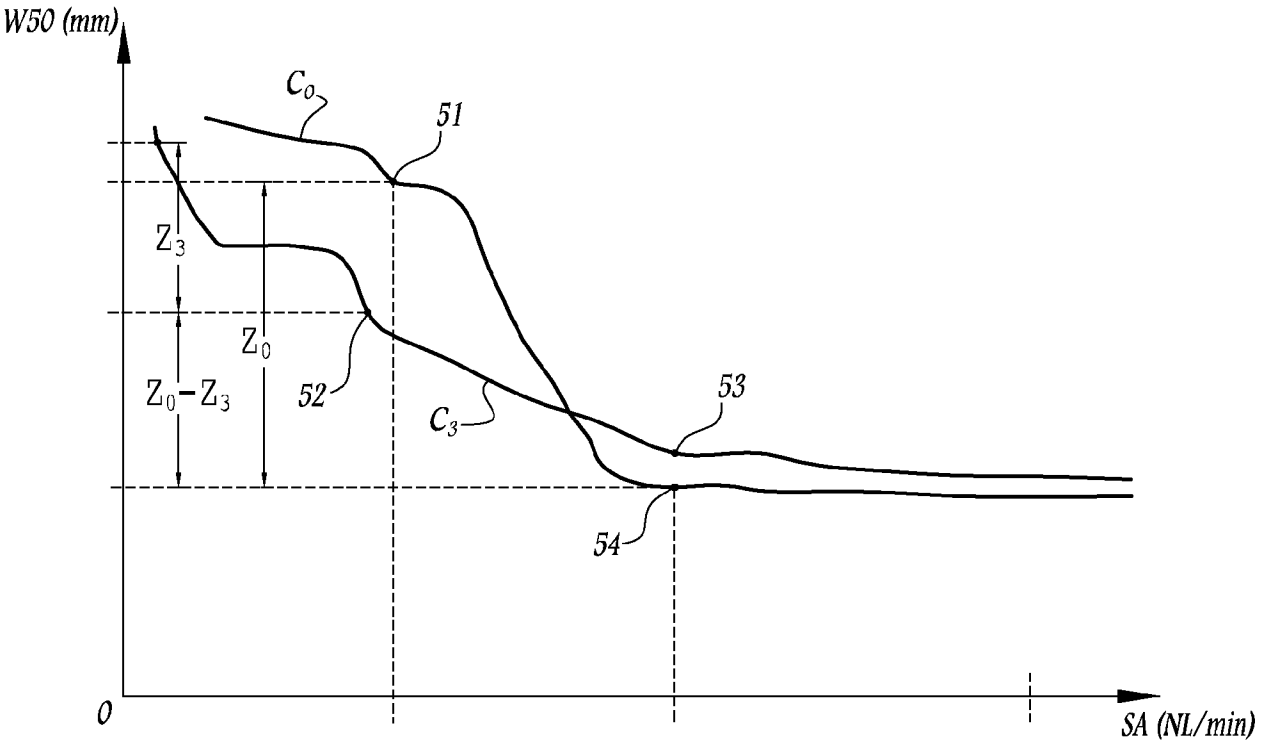
FIG. 8 is a graph illustrating some advantages of the rotary projector and the spraying member according to the invention relative to the prior art.

FIG. 8 shows a graph illustrating, as a function of the skirt air SA flow to shape the jet of sprayed material, the variations of the impact width W50 of the dynamic impact, i.e. on an object in motion, measured at the middle thickness of the deposition profile, as indicated above relative to the state of the art.

A curve $C_0$ represents the robustness curve of the impact width W50 of a rotary projector of the prior art, while a curve $C_3$ represents the robustness curve of a rotary projector according to the invention, i.e. comprising means 3 for injecting air into the volume delimited by the flow surface 11.

Each of the curves $C_0$ and $C_3$ has a zone where the impact width W50 evolves discontinuously. These zones are denoted $Z_0$ and $Z_3$ for curves $C_0$ and $C_3$, respectively. The zones $Z_0$ and $Z_3$ are called "non-robust," because the impact width W50 evolves there discontinuously when the skirt air SA flow is modified, so that the non-robust zones $Z_0$ and $Z_3$ cannot be used to spray the coating material. In fact, in a non-robust zone $Z_0$ or $Z_3$, a low variation of an external parameter, such as the speed of rotation of the bowl 1, the material flow rate or the movement of the multi-axis robot arm on which the rotary projector P is mounted, can greatly modify the aeraulic speed around the bowl 1 and cause the impact width W50 to vary irregularly.

The non-robust zone $Z_3$, with air injection at the center of the bowl 1, represents a relatively small variation of the impact width W50, while the robust zone $Z_0$, without air injection at the center of the bowl 1, represents a greater variation of the impact width W50. A rotary projector P according to the invention, with air injection at the center of the bowl 1, therefore makes it possible to reduce the amplitude of the non-robust zone $Z_0$ and return it to the non-robust zone $Z_3$. The decrease in this amplitude is reflected in FIG. 8 by the zone $Z_0$-$Z_3$, which shows a variation of the diameter W50 of about 200 mm.

As a result, the variations of the impact width W50 following the curve $C_3$ are lower, which makes it possible to apply the coating material as retinting layer, to superimpose a fine layer of coating material on a base layer that has already been applied. Retinting is an application in which the skirt air flow rate is relatively low and the speed of rotation of the bowl is relatively high.

Furthermore, it is possible to optimize the method of using the rotary projector P. To that end, it is necessary to exploit all of the areas of the curves $C_0$ and $C_3$ where the impact width W50 is robust.

In the example of FIG. 8, when the skirt air SA flow rate is increased from several NL/min to 600 NL/min, it is first necessary to spray the coating material without injecting air at the center of the bowl 1 to follow the initial robust part of the curve $C_0$ to a point 51. Then, it is preferable to inject more or less air flow into the center of the bowl 1, to situate oneself at a point 52 starting a robust zone of the curve $C_3$. It is then necessary to follow the curve $C_3$ to a point 53, while keeping the air injection at the center of the bowl 1. Then, in the same sequence, it is possible to continue following the curve $C_3$ from the point 53 when one increases the skirt air SA flow.

Alternatively, it is possible to follow the curve $C_o$, therefore to interrupt the injection of air into the center of the bowl 1, from a point 54, when one increases the skirt air SA flow. The air flow inside the bowl 1 can therefore be injected in a sequenced mode, in a continuous mode, i.e. with a constant value, or in variable mode.

This maximum and juxtaposed exploitation of the robust zones of the curves $C_0$ and $C_3$ also makes it possible to minimize the skirt air SA consumption, by following curve $C_0$ rather than curve $C_3$ between the flow rates corresponding to points 51 and 54.

Figure 3:
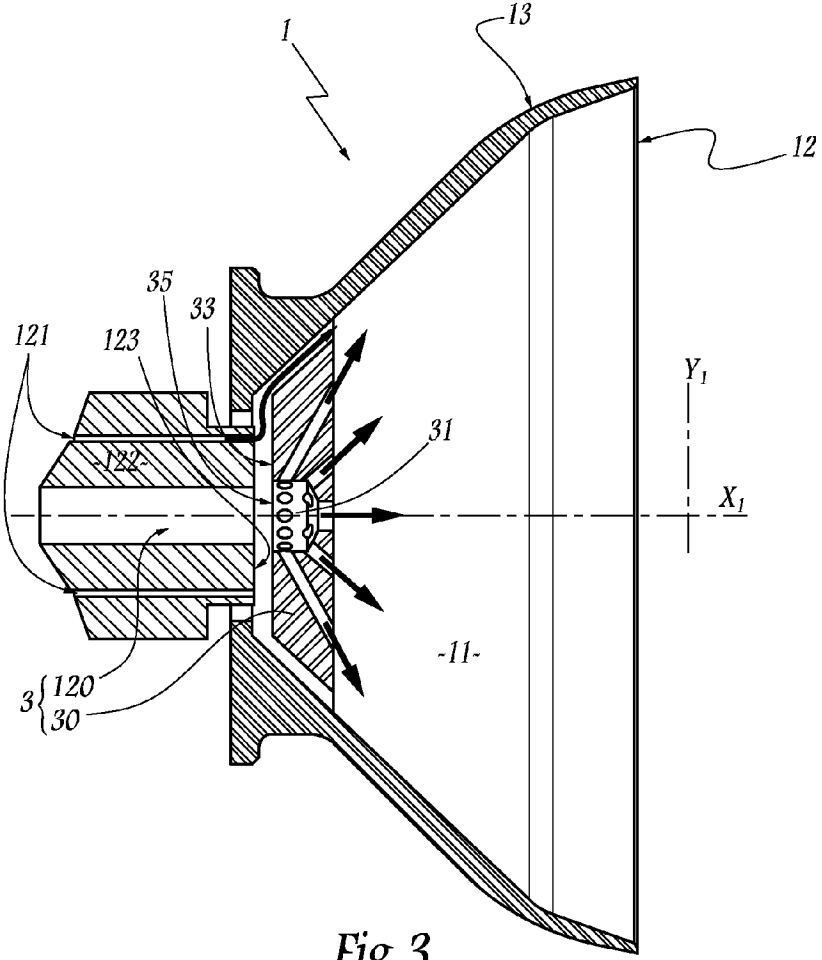
FIG. 3 is a view similar to FIG. 2 of part of a projector and a spraying member according to a second embodiment of the invention.

FIG. 3 illustrates a second embodiment of the invention, in which the bowl 1 is identical to the bowl 1 of FIG. 2. The description of the bowl 1 given above relative to FIG. 2 can therefore be transposed to the bowl 1 illustrated in FIG. 3. Elements of the rotary projector of FIG. 3 that are similar or correspond to those of the rotary projector P bear the same numerical references increased by 100. A conduit shown by its downstream section 122, an air pipe 120 and a tubing 121 are thus defined.

The rotary projector partially illustrated in FIG. 3 differs from the rotary projector P of FIG. 2 by the structure of the means for supplying the bowl 1 with coating material and by their position relative to the means for injecting air in the center of the bowl 1.

The downstream section of the conduit 122 includes the air pipe 120, which is identical to the air pipe 20 of the downstream section 22 of the conduit 24. In particular, the air pipe 120 is coaxial to the axis $X_1$. The air-injecting means 3, which include the air pipe 120 and the air dispenser 30, are therefore identical to the means 3 illustrated in FIG. 1.

In particular, the air leaving the pipe 120 penetrates the chamber 31 shared by the dispenser 30 through an opening 35 formed on the upstream side of this dispenser.

The section 122 differs from the downstream section 22 of the conduit 24 in that the means for supplying coating material comprise the tubing 121, which has a tubular shape extending around the air pipe 120 and coaxially to the axis $X_1$, while the tubing 21 is formed by a single piercing eccentric relative to the axis $X_1$. The tubular shape of the tubing 121 makes it possible to distribute the coating material uniformly on the perimeter of the air dispenser 30 and in the space separating the upstream surface 33 of the air dispenser 30 and the downstream surface 123 of the conduit 122.

Alternatively, the tubing 121 can have, like the tubing 21 described above relative to FIG. 2, a piercing extending parallel to the air pipe, therefore to the axis of rotation, and eccentrically in the conduit.

Figure 4:
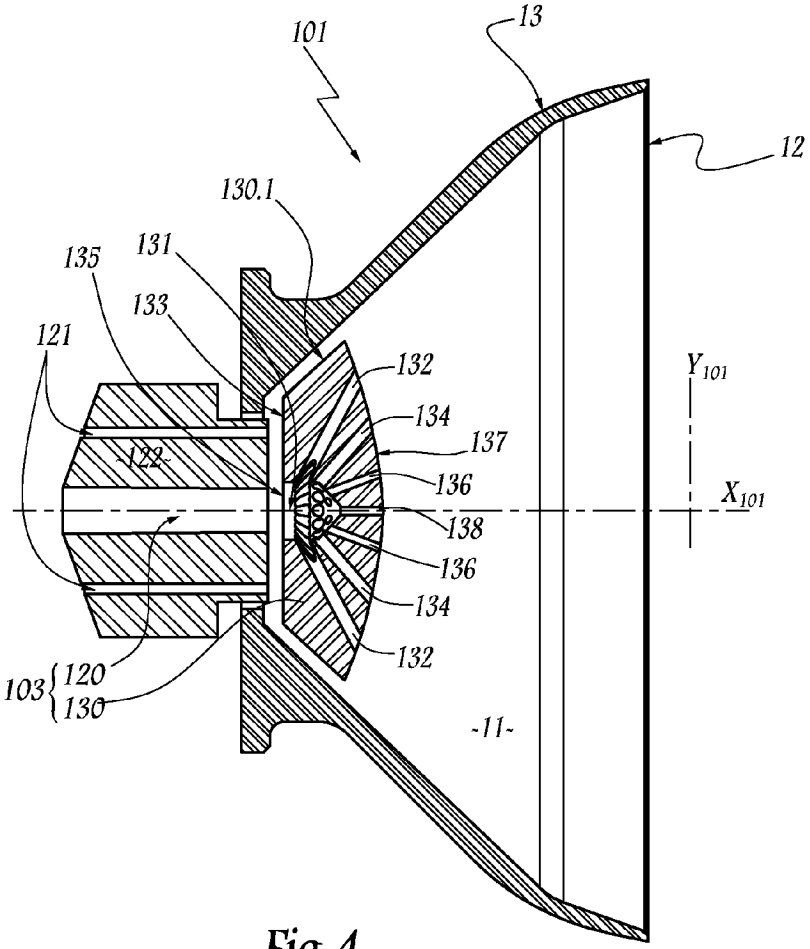
FIG. 4 is a view similar to FIG. 2 of part of a projector and a spraying member according to a third embodiment of the invention.

FIG. 4 illustrates a bowl 101 according to a third embodiment of the invention, in which the downstream section 122 of the conduit is identical to the section 122 of FIG. 3 and the bowl 101 is similar to the bowl 1. The description of the bowl 1 and the section 122 provided above relative to FIG. 3 can therefore be transposed to the bowl 1 and the section 122 of FIG. 4, taking into account the differences stated below. Elements of the rotary projector of FIG. 4 that are similar or correspond to those of the rotary projector P bear the same numerical references increased by 100. An air dispenser 130, a shared chamber 131, channels 132, 134, 136 and 138, an opening 135 for accessing the chamber 131, a downstream axial surface 137, and an outer surface 130.1 are thus defined.

The bowl 101 differs from the bowl 1, because it includes an air dispenser 130 whereof the shape and number of channels differ from those of the air dispenser 30. The other characteristics of the air dispenser 130 are identical to the corresponding characteristics of the air dispenser 30, in particular its upstream axial surface 133 and its outer surface 130.1.

The pipe 120 of the section 122 and the air dispenser 130 together form a means 103 for injecting air into a central region of the bowl 101, situated radially inside its flow surface 11.

First, the air dispenser 130 differs from the air dispenser 30 in that its downstream axial surface 137 is curved and convex, in this case in the shape of a sphere portion, while it is flat in the case of the downstream axial surface 37. The shape of the air dispenser 130 makes it possible to perform an air distribution different from the distribution obtained with the air dispenser 30, which can prove useful depending on the desired application. According to one alternative not shown, the downstream axial surface of the air dispenser 30 can be curved and concave, i.e. hollow.

Furthermore, the air dispenser 130 includes more channels 132, 134, 136 and 138 than the air dispenser 30. The distribution of the channels 132, 134, 136 and 138 is similar to the distribution of the channels 32, 34 and 36 that was described above relative to FIG. 2.

Figure 5:
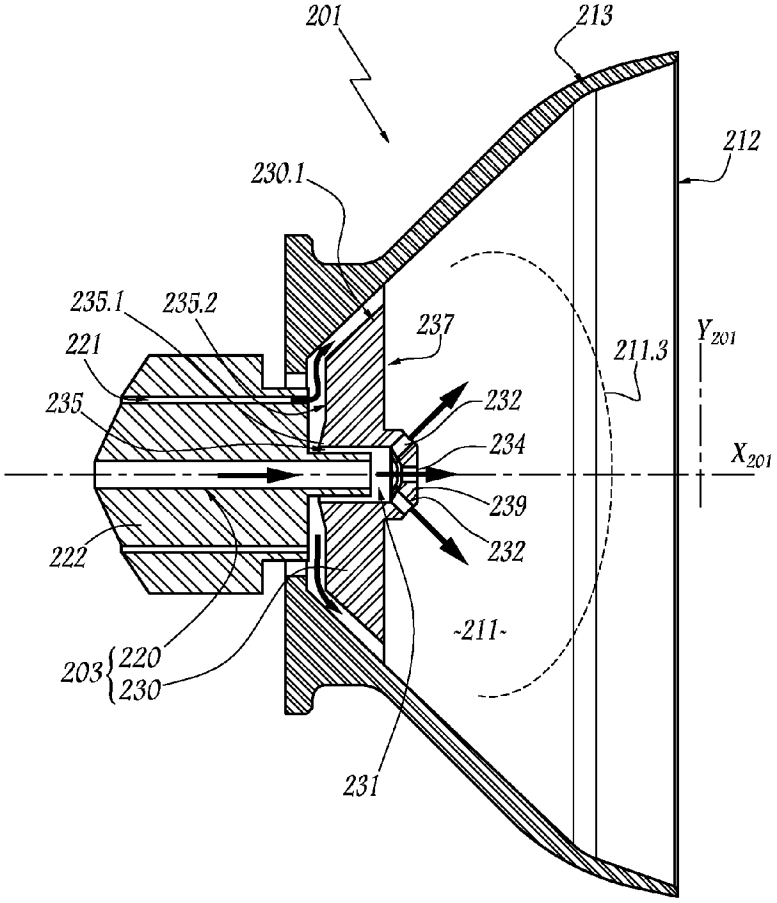
FIG. 5 is a view similar to FIG. 2 of part of a projector and a spraying member according to a fourth embodiment of the invention.

FIG. 5 illustrates a bowl 201 according to a fourth embodiment of the invention, in which the downstream section 122 of the conduit is identical to the section 122 of FIG. 3. The description of the bowl 1 and the conduit 122 provided above relative to FIG. 3 can be transposed to the bowl 201 and the section 122 of FIG. 5, taking into account the differences stated below. Elements of the rotary projector of FIG. 5 that are similar or correspond to those of the rotary projector P bear the same numerical references increased by 200. A flow surface 211, an edge 212, an outer surface 213, an air dispenser 230, a shared chamber 231, channels 232 and 234, an opening 235 for accessing the chamber 231, a downstream axial surface 237, an outer surface 230.1, and a central region 211.3 and air-injecting means 203 formed by the pipe 120 of the dispenser 122 and the air dispenser 230 are thus defined.

The flow surface 211, the edge 212 and the outer surface 213 are identical to the flow surface 11, the edge 12 and the outer surface 13, respectively. The bowl 201 differs from the bowl 1 by the structure and number of channels of its air dispenser 230. The channels 232 and 234 are in fact machined in a downstream portion 239 of the dispenser 230 that protrudes relative to the downstream axial surface 237. The downstream axial surface 237 is therefore partially planar, because it is made up of a planar crown and a protruding and tapered portion. The shared chamber 231 extends to this protruding portion. A significant flat portion of the downstream axial surface 237 is thus freed from the channels 232 and 234.

The downstream end of the section 222 penetrates the shared chamber 231, through the opening 235, with radial play, which forms a baffle locally generating load losses that limit the rise of paint into the air dispenser 230. For the purpose of preventing paint from rising up between the dispenser 230 and the outer radial surface of the chamber 231, the upstream axial surface 235.2 is provided with a tapered rim or bead 235.1 which radially adjoins, on the outside, the opening 235 and the chamber 231.

The other characteristics of the air dispenser 230 are identical to the corresponding characteristics of the air dispenser 30 and 130, in particular the outer surface 230.1 of the air dispenser 230 has a tapered shape.

The air dispenser 230 makes it possible to perform a more localized air distribution at the center of the central region 211.3 than is allowed by the air dispenser 30 or 130.

Figure 6:
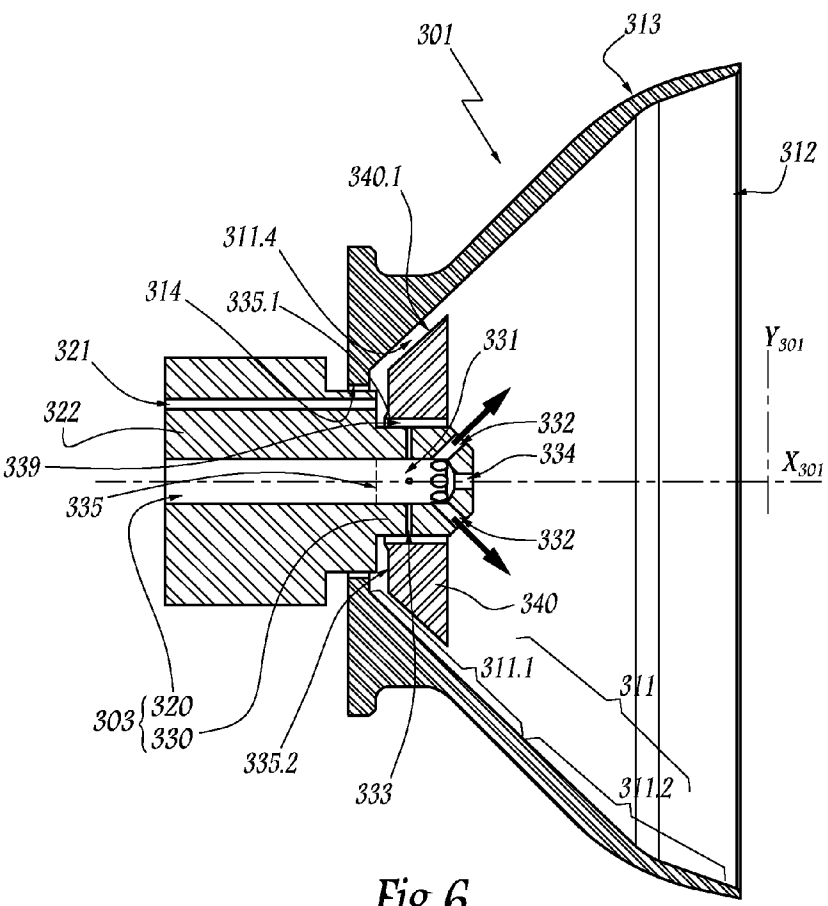
FIG. 6 is a view similar to FIG. 2 of part of a projector according to a fifth embodiment of the invention.

FIG. 6 illustrates a bowl 301 according to a fifth embodiment of the invention. The description of the bowl 1 and the conduit 24, in particular its downstream section 22, provided above relative to FIG. 1 can be transposed, in FIG. 6, to the bowl 301 and the conduit shown by its downstream section 322, taking into account the differences stated below. Elements of the rotary projector of FIG. 6 similar or corresponding to those of the rotary projector P bear the same numerical references increased by 300. A flow surface 311, upstream 311.1 and downstream 311.2 parts, a central region 311.3, an edge 312, an outer surface 313, an air dispenser 330, a shared chamber 331 and channels 332 and 334 are thus defined.

The air dispenser 330 has channels 332, 334 similar to the channels 232, 234 of the bowl 201. The air dispenser 330 differs from the dispensers 30, 130 and 230 in that it is detached from the bowl 301 and fixed relative to the fixed body of the rotary projector. On the contrary, the air dispensers 30, 130 and 230 are respectively secured to the bowls 1, 101 and 201, with the result that the air dispensers 30, 130 and 230 rotate around the axes $X_1$, $X_{101}$ and $X_{201}$, relative to the fixed body of the rotary projector P.

The pipe 320 of the tubing 322 and the air dispenser 330 together form means 303 for injecting air into a region of the bowl 301 situated radially inside the flow surface 311.

In the embodiment shown in FIG. 6, the air dispenser 330 is made at a downstream portion of the air pipe 320. In practice, the air dispenser 330 is machined in the downstream portion of the section 322 so as to form a protrusion through the upstream opening 314 of the bowl 301 and in the central radial part of the bowl 301. The air dispenser 330 and the section 322 are therefore integral. Alternatively, the air dispenser can be attached on the conduit by screwing, adhesion or equivalent.

The pipe 320 and the chamber 331 are one in the extension of the other and connect at an opening 335, which is in fact formed by an internal zone of sub-assembly 322-330. The air therefore penetrates the pipe 320 in the chamber 331 through the opening 335.

The bowl 301 also includes a distributor 340 that performs the function of distributing the coating material on the upstream part 311.1 of the flow surface 311. The distributor 340 is secured to the bowl 301 and rotates with it around the axis $X_{301}$. The distributor 340 has an outer surface 340.1 that defines, with the upstream part 311.1, a passage 311.4 for the coating material.

In addition to the channels 332 and 334, the air dispenser 330 includes lateral channels 333. The lateral channels 333 extend radially and they are distributed around the axis $X_{301}$. Air flows through the lateral channels 333 toward an annular interstice 339 situated between the dispenser 330 and the distributor 340, so that the paint does not flow in the interstice 339. To the same end of preventing paint from rising between the dispenser 330 and the distributor 340, the upstream axial surface 335.2 is provided with a tapered rim or bead 335.1 similar to the rim 235.1 of the embodiment of FIG. 5.

For the bowl 301, the air-injection means comprise the bore that defines the interstice 339, because the air dispenser 330 injects air, also through said bore. The air-injection means differs from the paint supply means formed by the distributor 340.

The air dispenser 330 makes it possible to produce static air jets, as opposed to the dynamic or rotary air jets produced by the air dispensers 30, 130 and 230. Static air jets have the advantage of being particularly directive and they have a relatively more significant local impact than dynamic jets.

Figure 7:
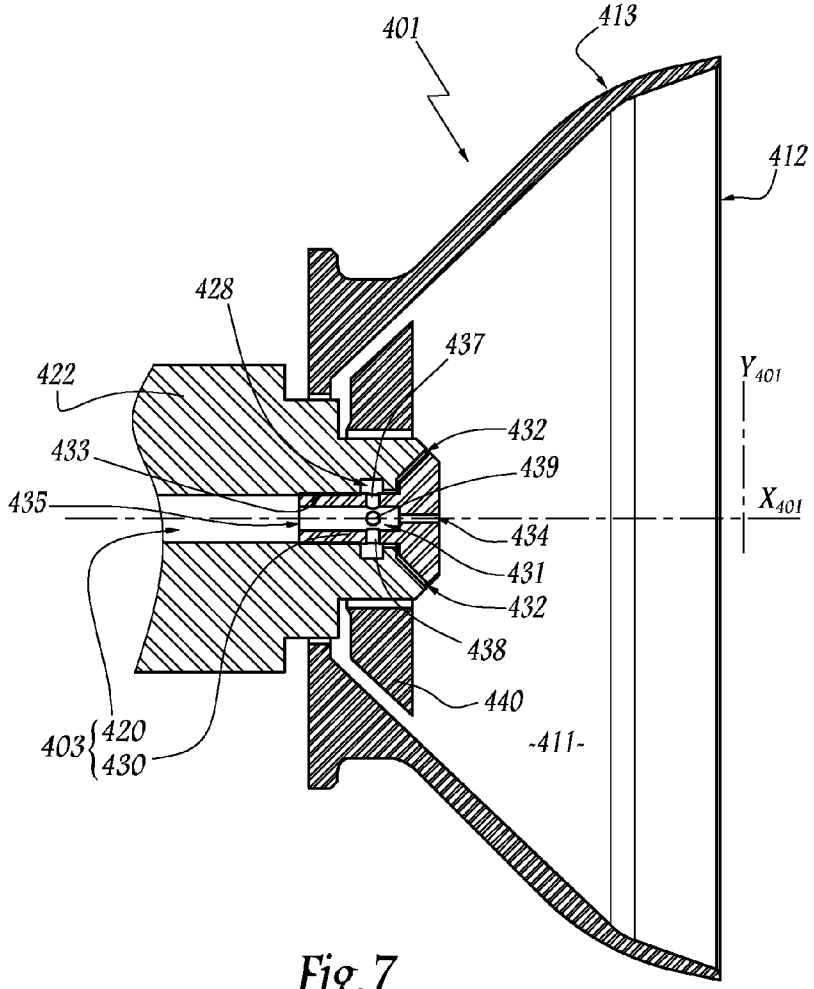
FIG. 7 is a view similar to FIG. 2 of part of a projector according to a sixth embodiment of the invention.

FIG. 7 illustrates a bowl 401 according to a sixth embodiment of the invention. The description of the bowl 301 and the downstream conduit section 322 provided above relative to FIG. 6 can be transposed, in FIG. 7, to the bowl 401 and to the conduit shown by its downstream section 422, taking into account the differences stated below. Elements of the rotary projector of FIG. 7 similar or corresponding to those of the rotary projector of FIG. 6 bear the same numerical references increased by 400. A flow surface 411, an edge 412, an outer surface 413, an air dispenser 430, a shared chamber 431, channels 432 and 434, an opening 435 for accessing the chamber 431 and a distributor 440 are thus defined.

The pipe 420 of the section 422 and the air dispenser 430 together form means 403 for injecting air into a region of the bowl 401 situated radially inside the flow surface 411. One (or more) tubings (not shown) allow the bowl 401 to be supplied with coating material. Each tubing extends in the section 422 and emerges upstream of the distributor 440. Each tubing can be similar to a tubing 21, 121, 221 or 321 as described above, i.e. straight and parallel to the axis $X_{401}$ or tubular and coaxial to the axis $X_{401}$.

Unlike the air dispenser 330, the air dispenser 430 comprises a nozzle that is fastened to the end of the section 422. More specifically, the air dispenser 430 includes a tubular upstream part that is screwed in the pipe 420 whereof the downstream end part is threaded 433. The air dispenser 430 is easy to disassemble and clean, because it has an unscrewable nozzle. Alternatively, the nozzle can be fastened in the conduit by fins.

The air dispenser 430 is separate from the bowl 401 and fixed relative to the fixed body of the rotary projector. The air dispenser 430 has a channel 434 similar to the channel 334 of the bowl 301. The downstream part of the air dispenser 430 has a tapered shape at the center of which the channel 434 is pierced along the axis $X_{401}$. The air supplying the channel 434 comes from the shared chamber 431.

An interstitial space, or play, is arranged between the tapered surface of the air dispenser 430 and the coincident end surface of the section 422. This interstitial space forms a lamellar channel 432 extending around the axis $X_{401}$.

The air reaches the channel 432 via several radial piercings, three of which are visible in FIG. 7 with references 437, 438 and 439. The radial piercings 437 and 438 extend in the radial direction $Y_{401}$ contained in the plane of FIG. 7. These radial piercings 437, 438 and 439 are made in the tubular upstream part of the air dispenser 430 and they emerge in an annular channel 428 that is made in the conduit 422.

Thus, the nozzle forming the air dispenser 430 makes it possible to inject a lamellar air stream in the region situated radially inside the flow surface 411.

The embodiments described above, in particular relative to FIGS. 1 to 7, offer all of the primary advantages of the invention, i.e. overcoming the vacuum downstream of the bowl, obtaining good robustness of the impacts of coating materials on the objects to be coated, and limiting dirtying of the components of the bowl.

According to another alternative that is not shown, the tubing for the coating material and the air pipe can be machined in two different pieces assembled using conventional fastening means.

Furthermore, the air injected at the center of the bowl can be replaced by another inoffensive and neutral gas relative to the coating material, such as nitrogen.

In all of the embodiments, the air pipe 20, 120, 220, 320 or 420 is centered on the axis of rotation $X_1, \ldots X_{401}$ of the bowl 1, . . . 401 and the dispenser 30, 130, 230 or 430 is also centered on said axis. The flow of air between the pipe and the dispenser therefore takes place along this axis.

In all of the embodiments, the air dispenser 30 or equivalent is arranged in the volume delimited by the upstream part 11.1 or equivalent, of the flow surface 11 or equivalent, of the bowl. In other words, the air dispenser 30 or equivalent fits into the volume delimited by the flow surface 11 or equivalent of the bowl. This location of the dispenser allows it to effectively distribute the air both toward the flow surface and the center of the bowl, which in particular makes it possible to overcome any vacuum in the central region of the bowl or downstream of said region. The robustness of the impact and the deposition yield are thereby improved.

The invention claimed is:

1. A rotary projector for a coating material, comprising
a fixed body,
a coating material spraying member,
means for rotating the spraying member around a rotational axis,
means for supplying the spraying member with a coating material,
the spraying member for the coating material comprising:
at least one flow surface for receiving the coating material,
at least one edge for spraying the coating material, the edge being in fluid communication with the flow surface,
the rotary projector also comprising means for injecting air into a region located radially inside a space defined by the flow surface and upstream from the edge, the air-injecting means being separate from the coating material supply means,
wherein the air-injecting means includes an air dispenser arranged in an upstream portion of the flow surface to inject air into a central area, radially and axially, of the flow surface.

2. The rotary projector according to claim 1, wherein the air-injecting means are arranged so as to orient all or some of the air toward the flow surface.

3. The rotary projector according to claim 1, wherein the air dispenser is separate from the spraying member and stationary relative to the fixed body.

4. The rotary projector according to claim 3, wherein the air dispenser comprises a nozzle that is removably fastened to the means for injecting air and/or the supply means.

5. The rotary projector according to claim 1, wherein the means for injecting air comprise an air pipe extending upstream of the spraying member, the downstream section of the air pipe extending substantially parallel and close to the axis of rotation, said downstream section preferably being coaxial to the axis of rotation.

6. The rotary projector according to claim 5, wherein the means for supplying the coating material comprise a tubing whereof the downstream section extends generally parallel to the air pipe and spaced away from the axis of rotation.

7. The rotary projector according to claim 5, wherein the means for supplying the coating material comprise a tubing that is tubular and extends around the air pipe.

8. The rotary projector according to claim 7, wherein the air dispenser is separate from the spraying member and stationary relative to the fixed body and wherein the air dispenser is made at a downstream portion of the air pipe.

9. The rotary projector according to claim 1, wherein the air dispenser is secured to the spraying member.

10. The rotary projector according to claim 1, wherein the air dispenser has at least one opening arranged upstream of the air dispenser to receive a stream of air, as well as at least one channel extending downstream of the opening.

11. The rotary projector according to claim 10, wherein the air dispenser has several channels that converge downstream of the opening and the discharge directions of which are distributed in a solid angle greater than a solid angle inscribing the flow surface and smaller than $2\pi$ steradians, certain channels being oriented toward the flow surface.

12. The rotary projector according to claim 1, wherein a downstream axial surface of the air dispenser is completely or partially planar.

13. The rotary projector according to claim 1, wherein a downstream axial surface of the air dispenser is curved, in the shape of a sphere portion.

14. The rotary projector according to claim 1, wherein the flow surface generally has a symmetry of revolution relative to the axis of rotation and the air dispenser (30; 130; 230; 330; 430) has a globally tapered outer surface around the axis of rotation, the outer surface defining, with the flow surface, a passage for the coating material.

15. A rotary member for spraying a coating material comprising:

at least one flow surface intended to receive the coating material conveyed by a means for supplying the coating material, at least one edge for spraying said coating material, the edge being in fluid communication with the flow surface, the rotary member also comprising means for injecting air into a region situated radially inside a volume delimited by the flow surface and upstream of the edge, the air-injecting means being separate from the means for supplying the coating material, wherein the air-injecting means comprise an air dispenser that is arranged in an upstream part of the flow surface to inject air into a central region, radially and axially, of the flow surface and in that said air dispenser is integral with the spraying member.

16. A method for projecting a coating material, using a rotary projector according to claim 1 and wherein the method comprises:

supplying the spraying member with coating material;

injecting air into the region situated radially inside the spaced defined by the flow surface using the air dispenser arranged in an upstream part of the flow surface of the spraying member;

selecting one or more air flow(s), in a continuous, variable or direct mode, flowing into the air-injecting means.

17. The rotary projector according to claim 6, wherein the air dispenser is separate from the spraying member and stationary relative to the fixed body and wherein the air dispenser is made at a downstream portion of the air pipe.

* * * * *